US008490245B2

(12) United States Patent
Meyer

(10) Patent No.: US 8,490,245 B2
(45) Date of Patent: Jul. 23, 2013

(54) HINGE FOR CONNECTING A LEAF TO A FRAME SO AS TO BE HINGED ABOUT A HINGE AXIS

(75) Inventor: Eckard Meyer, Korschenbroich (DE)

(73) Assignee: Dr. Hanh GmbH & Co. KG, Moenchengladbach-Wickrath (DE)

( * ) Notice: Subject to any disclaimer, the term of this patent is extended or adjusted under 35 U.S.C. 154(b) by 25 days.

(21) Appl. No.: 13/123,534

(22) PCT Filed: Oct. 16, 2009

(86) PCT No.: PCT/EP2009/063590

§ 371 (c)(1),
(2), (4) Date: Apr. 11, 2011

(87) PCT Pub. No.: WO2010/049292

PCT Pub. Date: May 6, 2010

(65) Prior Publication Data

US 2012/0017396 A1 Jan. 26, 2012

(30) Foreign Application Priority Data

Oct. 28, 2008 (DE) ..... 20 2008 014 318 U

(51) Int. Cl.
*E05D 11/00* (2006.01)

(52) U.S. Cl.
USPC ..... 16/223

(58) Field of Classification Search
USPC ..... 16/223; 439/61.7
See application file for complete search history.

(56) References Cited

U.S. PATENT DOCUMENTS

| | | | | |
|---|---|---|---|---|
| 2,688,733 | A * | 9/1954 | Walter, Jr. | 439/31 |
| 3,838,234 | A | 9/1974 | Peterson | |
| 3,842,386 | A * | 10/1974 | Suska | 439/31 |
| 3,848,361 | A * | 11/1974 | Foster et al. | 49/167 |
| 3,857,625 | A * | 12/1974 | Crane et al. | 439/31 |
| 6,516,495 | B1 * | 2/2003 | Michalak | 16/320 |
| 8,104,823 | B2 * | 1/2012 | Kohlstrand | 296/146.1 |
| 2003/0234743 | A1 * | 12/2003 | Ponce De Leon et al. | 343/702 |
| 2012/0066864 | A1 * | 3/2012 | Boegel-Poetter et al. | 16/273 |

FOREIGN PATENT DOCUMENTS

| | | | |
|---|---|---|---|
| DE | 93 02 652 | U1 | 8/1994 |
| DE | 203 04 980 | U1 | 6/2003 |
| DE | 103 15 208 | A1 | 10/2004 |
| DE | 20 2004 013 963 | U1 | 11/2004 |
| DE | 10 2004 017 341 | A1 | 1/2005 |
| EP | 0 621 905 | B1 | 5/1998 |

* cited by examiner

*Primary Examiner* — Victor Batson
*Assistant Examiner* — Matthew Sullivan
(74) *Attorney, Agent, or Firm* — Norman B. Thot

(57) ABSTRACT

A hinge plate for connecting at least one of a leaf, a door, a window or the like to a frame so as to be hinged about a hinge axis includes a frame hinge plate part configured to be fastened to the frame. The frame hinge plate part includes a leaf hinge part, a frame fastening part and a frame hinge part. A leaf hinge plate part is configured to be fastened to the leaf. The leaf hinge plate part including a leaf fastening part. A hinge plate pin is configured to define the hinge axis, the hinge plate pin being mounted in bearing bushes which include electric coils. The bearing bushes are disposed in each of the frame hinge part and in the leaf hinge part. The hinge plate pin is provided as a flux guiding element configured to guide electromagnetic flux lines between the electric coils.

15 Claims, 2 Drawing Sheets

HINGE FOR CONNECTING A LEAF TO A FRAME SO AS TO BE HINGED ABOUT A HINGE AXIS

CROSS REFERENCE TO PRIOR APPLICATIONS

This application is a U.S. National Phase application under 35 U.S.C. §371 of International Application No. PCT/EP2009/063590, filed on Oct. 16, 2009 and which claims benefit to German Patent Application No. 20 2008 014 318.7, filed on Oct. 28, 2008. The International Application was published in German on May 6, 2010 as WO 2010/049292 A1 under PCT Article 21(2).

FIELD

The present invention relates to a hinge plate for connecting a leaf of a door or a sash of a window or the like to a frame so as to be hinged about a hinge axis, said hinge plate having a frame hinge plate part, which can be fastened to the frame and includes a frame fastening part and a frame hinge part, a leaf hinge plate part or sash hinge plate part which can be fastened to the leaf or sash and includes a leaf fastening part or sash fastening part and a leaf hinge part or sash hinge part, and a hinge plate pin which defines the hinge axis and is mounted in bearing bushes provided in the frame hinge part and in the leaf hinge part or sash hinge part.

BACKGROUND

DE 93 02 652 U1 describes a hinge plate in which the bearing bushes serve, on the one hand, for the at least almost play-free and low-wear bearing arrangement of the hinge plate pin, and, on the other hand, for the adjustment between leaf or sash hinge plate part and frame hinge plate part in relation to each other in order to be able to adjust the leaf or sash in the frame. DE 93 02 652 U1 describes a hinge plate where the lower bearing bush of the frame hinge plate part is realized with an upper support for the lower end face of the leaf hinge part or sash hinge part and which is vertically adjustable by means of an adjusting spindle screwed-into the frame hinge part from below, on the upper side of which it is supported. A bearing bush can also be provided in the leaf hinge plate part or sash hinge plate part, it being possible for said bearing bush to be designed in a known manner as an eccentric or as an adjusting bush for adjustment in the direction perpendicular to the hinge axis.

These types of hinge plates have proved their worth many times in different technical developments as they not only provide reliable fastening of a leaf or sash to a frame, but also enable adjustment thereof in terms of as uniform a size of gap as possible between the leaf or sash and the frame. These types of hinge plates are therefore frequently used on doors for objects such as houses, shops or even as emergency exits.

These types of doors increasingly include devices which improve safety or convenience and which are operated by means of electric power.

For the supply of electricity, said devices are connected to an external power source either conductively, for example, by means of rubbing contacts, or by means of flexible cabling, or they have power storage themselves, for example, accumulators or batteries.

In the first-named case has the disadvantage that rubbing contacts are susceptible to failure and cable connections clearly impair the visual appearance. In the second case, operating costs are increased by the need for separate storage means. The space required by the storage means can additionally impair functionality and visual appearance.

SUMMARY

An aspect of the present invention is to provide a hinge plate whose functionality and outer appearance does not differ or does not differ significantly from previously known hinge plates, and whose retaining function allows for a reliable transfer of power to an extent necessary for the operation of popular convenience or safety devices provided on the leaf or sash.

In an embodiment, the present invention provides a hinge plate for connecting at least one of a leaf, a door, a window or the like to a frame so as to be hinged about a hinge axis which includes a frame hinge plate part configured to be fastened to the frame. The frame hinge plate part includes a leaf hinge part, a frame fastening part and a frame hinge part. A leaf hinge plate part is configured to be fastened to the leaf. The leaf hinge plate part including a leaf fastening part. A hinge plate pin is configured to define the hinge axis, the hinge plate pin being mounted in bearing bushes which include electric coils. The bearing bushes are disposed in each of the frame hinge part and in the leaf hinge part. The hinge plate pin is provided as a flux guiding element configured to guide electromagnetic flux lines between the electric coils.

BRIEF DESCRIPTION OF THE DRAWINGS

The present invention is described in greater detail below on the basis of embodiments and of the drawings in which.

DETAILED DESCRIPTION

Figure 1:
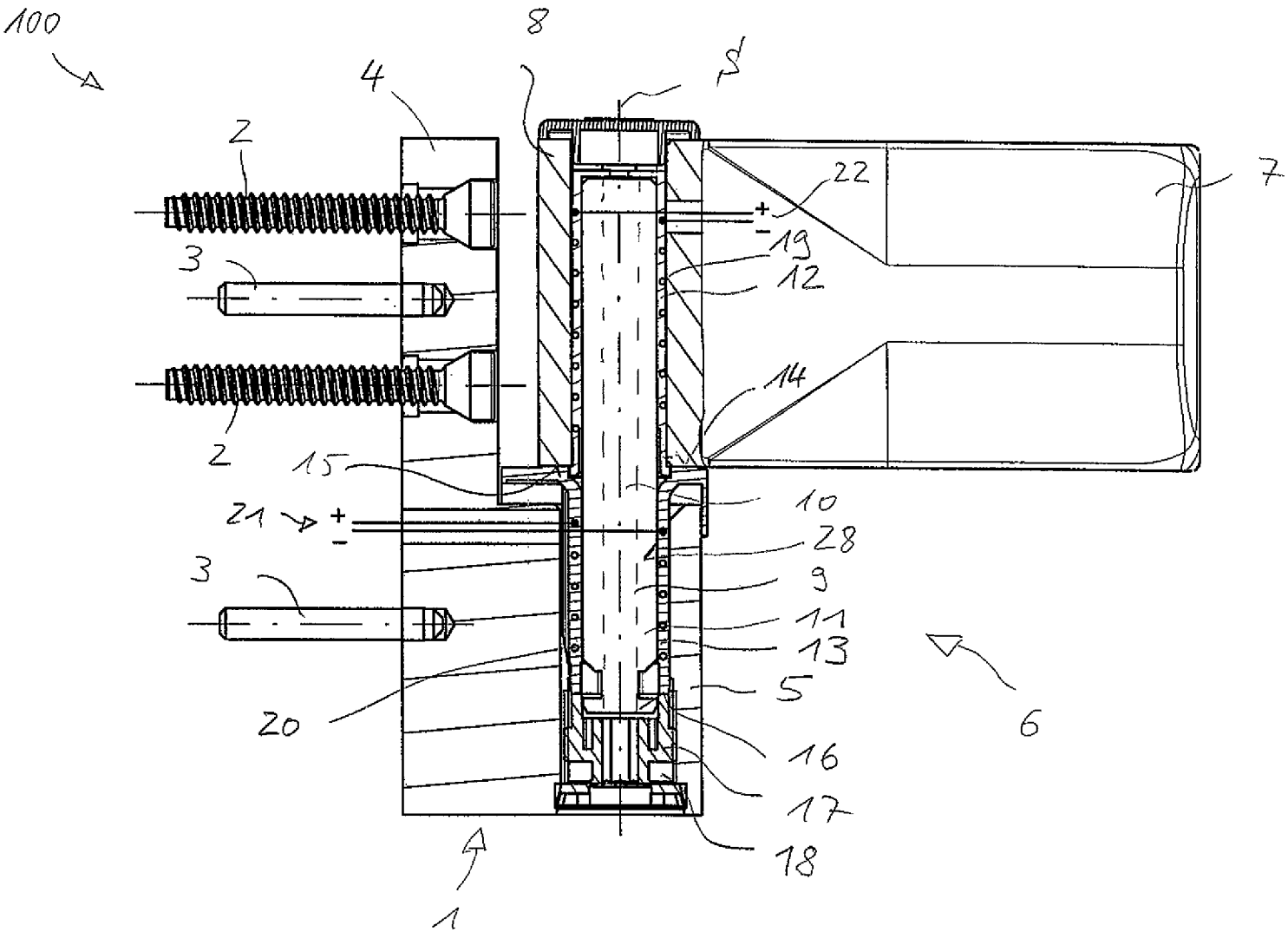
FIG. 1 shows a part-sectional, side view of an embodiment of the hinge plate of the present invention.

In an embodiment of the present invention, the bearing bushes include electric coil windings and the hinge plate pin is designed as guiding element for guiding electromagnetic flux lines between the coil windings.

It has been surprisingly shown that even where alternating currents at a frequency of approximately 50 Hz are used for transferring power, the magnetic coupling between the coils of the bearing bushes obtained in the case of this arrangement suffices for providing outputs within the wave range.

An advantage of the hinge plate according to the present invention is that outwardly it does not differ practically from popular hinge plates of the aforementioned type. It is not only the visual impression effected by a door/frame arrangement that contains a hinge plate according to the present invention that is essentially improved in this manner, but also the operating safety of said arrangement, as it either cannot be seen or only seen with difficulty from the outside whether and, where applicable, which of the hinge plates used in a leaf or sash/frame arrangement is designed as the conductive hinge plate.

It is possible, through the incorporation of the coils in the bearing bushes, to convert a conventional hinge plate, by exchanging the bearing bushes and possibly also the hinge plate pin, into a hinge plate by means of which electric power can also be transferred from the frame into the leaf or sash. Such a hinge plate is to be denoted below also as a "conductive hinge plate."

In an embodiment of the present invention, the windings of the coils can be arranged in an arbitrary spatial manner that provides electromagnetic coupling between the two coils sufficient for the transfer of power. For example, with a view to providing a simple producibility and as good an electromagnetic coupling as possible between the two coils, said coils can, for example, be wound approximately concentrically in relation to the hinge axis.

The windings can, for example, be embedded in the bearing bushes. This measure provides that they are protected, for example, from mechanical damage when the hinge plate is put together or from mechanical wear.

If the bearing bushes are produced from non-magnetic material, for example, from a low-friction plastics material, during the production of the bushes, the coils can, for example, be regularly inserted into the bush material that is initially present in most cases in liquid form. Once the bushes have been produced, the coils are then completely surrounded by the bush material and are consequently particularly unsusceptible to external influences.

In order to increase the inductance of the two coils for the purposes of improving the coupling, the hinge plate pin can, for example, include a paramagnetic material such as, for example, a ferromagnetic material.

Ferromagnetic material in particular, a material particularly suitable as coil core for increasing the inductance of the coil, is frequently brittle and consequently does not have the mechanical characteristics suitable for transferring the retaining and activating forces from the leaf or sash into the frame. In order to bestow upon the hinge plate pin the characteristics suitable both to increase the inductance of the coils and to transfer the forces, the hinge plate pin includes a core, which extends at least over part of the length thereof and is produced from a mechanically stable material, and an envelope, which surrounds the core and can be produced from ferromagnetic material. The ferromagnetic material can be arranged around the core in order to effect as small a gap as possible between the coils and the magnetically effective part of the hinge plate pin for the purposes of increasing the inductance.

In order to reduce losses in the hinge plate pin brought about by an eddy current, the envelope can, for example, include a plurality of layers produced from transformer sheet and separated electrically from each other. Said layers can be formed, for example, by envelopes which mesh in an approximately concentric manner or by flat layers which are stacked on top of each other and are perforated approximately in the centre, the core of the hinge plate pin extending through the perforation thereof, and which are provided with insulating varnish.

As an alternative or in addition thereto, the envelope can also include one or several layers produced from ferrite.

It is also possible to produce the envelope from a ferromagnetic compressed powder material or to provide it with a ferromagnetic compressed powder material.

Should it be necessary to improve the electromagnetic coupling between the two coils further in order to be able to transfer, for example, greater outputs in an electrically isolated manner from the frame hinge plate part into the leaf hinge plate part or sash hinge plate part, the frame hinge part and the leaf hinge part or sash hinge part can, for example, include additional flux guiding means for guiding electromagnetic flux to the hinge plate pin. It is possible to create an almost closed coil core by means of said flux guiding elements together with the hinge plate pin.

Said flux guiding means can be realized in a structural manner, for example, by end caps produced from paramagnetic or ferromagnetic material being provided on the leaf hinge part or sash hinge part and the frame hinge part and being arranged in the region of the two ends of the hinge plate pin. In addition, the flux guiding means can include flux guiding regions, which extend approximately parallel to the hinge axis, in each case to an end cap, and are produced from paramagnetic or ferromagnetic material in order to effect the magnetic flux between the end caps in this way.

To obtain as good a coupling as possible between the flux guiding regions of the frame hinge part and of the leaf hinge part or sash hinge part, the flux guiding regions can, for example be situated opposite each other at least substantially on the end faces of the hinge parts facing each other.

Part-sectional, side views of two exemplary embodiments of the hinge plate according to the present invention are schematically represented in the drawing.

The first exemplary embodiment of the hinge plate 100 includes a frame hinge plate part 1, which has a frame fastening part 4 that can be mounted on a front side of a frame (not shown in the drawing) by means of fastening screws 2 and dowel pins 3, and a frame hinge part 5 that is integrally formed on said frame fastening part. In addition, the hinge plate 100 includes a leaf hinge plate part or sash hinge plate part 6, which includes a leaf fastening part or sash fastening part 7 that can be mounted on a leaf or sash (not shown in the drawing) by means of fastening screws (not shown in the drawing either) and a leaf hinge part or sash hinge part 8 that is integrally formed on the leaf fastening part or sash fastening part 7.

A hinge plate pin 9 serves for connecting the frame hinge plate part 1 and the leaf hinge plate part or sash hinge plate part 6 so as to be hinged about a hinge axis S. Said hinge plate pin includes a core 10, which is only shown by the broken line in FIG. 1 and is produced from a mechanically high-strength material that is suitable for transferring the retaining and actuating forces acting between the frame hinge plate part 1 and the leaf hinge plate part or sash hinge plate part 6. The core 10 is surrounded by an envelope 11 produced from a ferromagnetic material. Said envelope can comprise individual flat discs, which are aligned perpendicular to the hinge axis S, produced from transformer sheet, for example, accommodate the core 10 in central perforations and are electrically insulated against each other to reduce the formation of electromagnetically induced ring currents with respect to one another, for example, by means of a coating with insulating varnish. The hinge plate pin consequently also serves as flux guiding element 28 for guiding electromagnetic flux lines.

Bearing bushes 12, 13 serve for the bearing arrangement of the hinge plate pin in the frame hinge part 5 and the leaf hinge part or sash hinge part 8. The lower bearing bush 13 of the frame hinge plate part has a support surface 14 on the end face thereof directed upward and the leaf hinge part or sash hinge part 8 is supported on said support surface 14 by way of the lower end face 15 thereof.

The lower bearing bush 13 rests by way of the lower end face 16 thereof on a threaded spindle 17, which is screwed from below into a threaded bore 18 in the frame hinge part 5. A relative displacement between the frame and leaf hinge plate parts or sash hinge plate parts 1, 6 for the purposes of adjusting the leaf or sash in a perpendicular manner in the frame can be effected by means of actuating the threading spindle 17 in a rotational manner.

For the purposes of adjusting the leaf or sash in a direction perpendicular to the hinge axis S, the bearing bush 12 of the leaf hinge part or sash hinge part 8 can be realized eccentrically in a known manner (not shown in the drawing).

The two bearing bushes 12, 13 are produced from plastics material hardened from a viscous phase in the production process. Embedded into the bush material are coils 19, 20, the windings of which extend approximately concentrically to the hinge axis S. The coil 20 of the lower bearing bushes 13 of the frame hinge part serves as primary coil, which in the event of an electric power transfer to the leaf or sash is acted upon with an electric alternating voltage via electric connecting lines 21.

The coil 19 arranged in the upper bearing bush 12 of the leaf hinge part or sash hinge part 8 accordingly forms a secondary coil, in which, on account of the electromagnetic coupling with the primary coil 20, via the hinge plate pin 9, a secondary voltage is induced which can be supplied to consumers located in the leaf or sash via an electric connecting line 22.

The number of windings of the two coils 19, 20 and the ratio between the number of windings of the primary coil and the number of windings of the secondary coil are dependent, among other things, on the output to be transferred and the frequency of the voltage pending at the primary coil. The mathematical interrelationships known from the design of transformers and transmitters can be used for adaptation to specific ratios.

Figure 2:
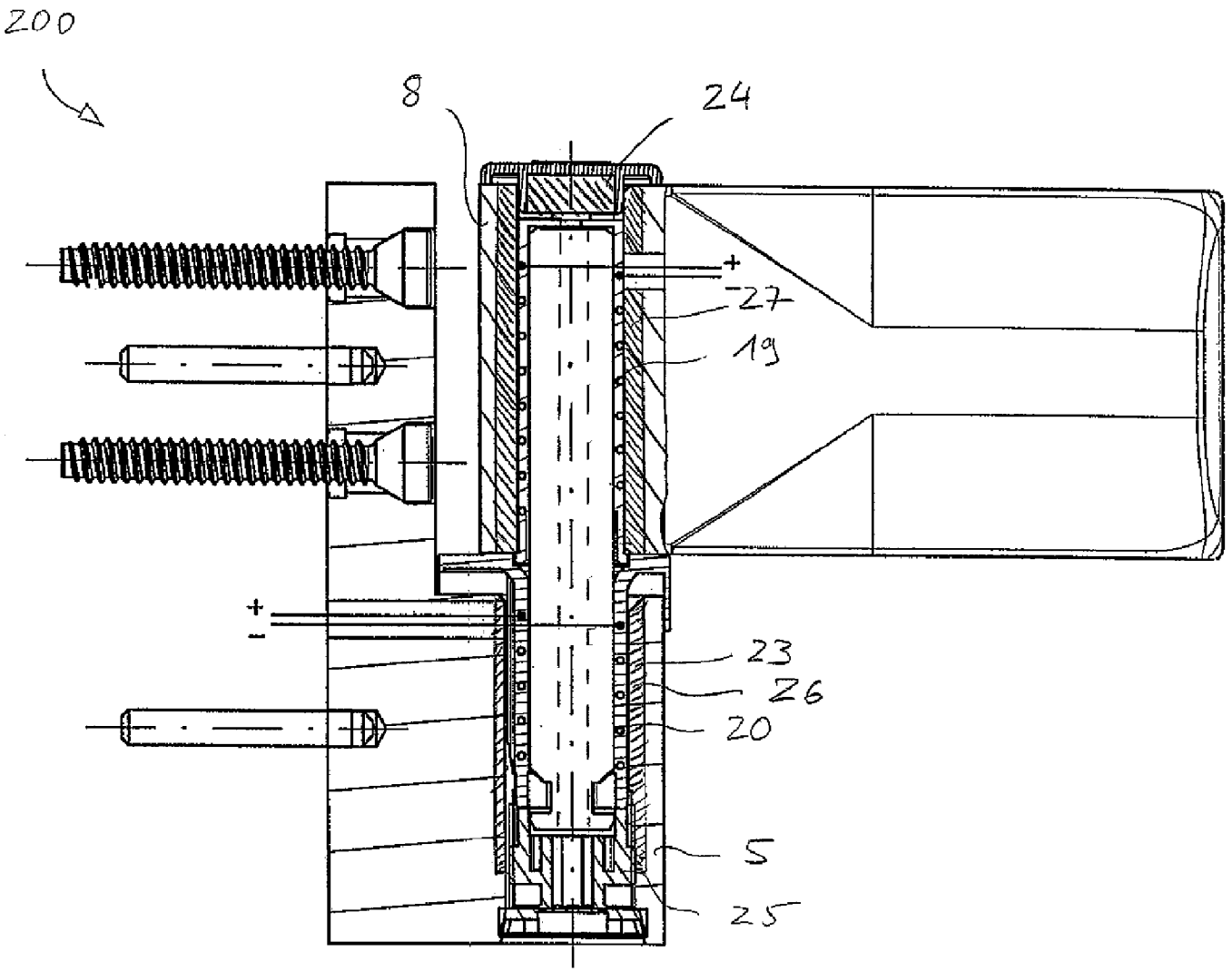
FIG. 2 shows a part-sectional, side view of an embodiment of the hinge plate of the present invention.

The second exemplary embodiment of a hinge plate 200 according to the present invention shown in FIG. 2 corresponds in the design and method of operation thereof substantially to the hinge plate 100 shown by way of FIG. 1. Consequently, only the differences will be discussed below.

In order to improve the electromagnetic coupling between the coils 19, 20 with the aim of being able to transfer higher electric outputs from the primary coil 20 into the secondary coil 19, the frame hinge part 5 and the leaf hinge part or sash hinge part 8 have flux guiding means 23 for guiding electromagnetic flux through the hinge plate pin. The flux guiding means 23 include an end cap 24, which is provided on the leaf hinge part or sash hinge part 8 and is produced from paramagnetic or ferromagnetic material, and an end cap 25, which is provided on the frame hinge part and is produced from paramagnetic or ferromagnetic material. In the exemplary embodiment shown, the end cap 25 is formed by the threaded spindle 17.

In addition, the flux guiding means 23 include flux guiding regions 26, 27, which extend approximately parallel to the hinge axis S, in each case to an end cap, are also produced from paramagnetic or ferromagnetic material and are inserted into the leaf hinge part or sash hinge part 8 or the frame hinge part 5. The flux guiding regions 26, 27 are arranged spatially in such a manner that they are situated opposite each other at least substantially on the end faces of the hinge parts 5, 8 facing each other with the leaf or sash closed. Optimisation of the electric power transfer from the primary side to the secondary side with the leaf or sash closed is consequently provided.

The present invention is not limited to embodiments described herein; reference should be had to the appended claims.

LIST OF REFERENCES

100, 200 Hinge plate
1 Frame hinge plate part
2 Fastening screws
3 Dowel pins
4 Frame fastening part
5 Frame hinge part
6 Leaf hinge plate part or sash hinge plate part
7 Leaf fastening part or sash fastening part
8 Leaf hinge part or sash hinge part
9 Hinge plate pin
10 Core
11 Envelope
12 Bearing bush
13 Bearing bush
14 Support surface
15 Lower end face
16 Lower end face
17 Threaded spindle
18 Threaded bore
19 Coil
20 Coil
21 Electric connecting line
22 Electric connecting line
23 Flux guiding means
24 End cap
25 End cap
26 Flux guiding region
27 Flux guiding region
28 Flux guiding element
S Hinge axis

The invention claimed is:

1. A hinge plate for connecting at least one of a leaf, a door, or a window to a frame so as to be hinged about a hinge axis, the hinge plate comprising:

a frame hinge plate part configured to be fastened to the frame, the frame hinge plate part including a frame fastening part and a frame hinge part;

a leaf hinge plate part configured to be fastened to the leaf, the leaf hinge plate part including a leaf fastening part;

a leaf hinge part; and a hinge plate pin configured to define the hinge axis, the hinge plate pin being mounted in bearing bushes which include a first electric coil and a second electric coil, the bearing bushes being disposed in each of the frame hinge part and in the leaf hinge part, wherein the hinge plate pin is provided as a flux guiding element configured to guide electromagnetic flux lines between the first electric coil and the second electric coil, and wherein the first electric coil and the second electric coil do not physically contact each other.

2. The hinge plate as recited in claim 1, wherein the electric coils include windings extending approximately concentrically in relation to the hinge axis.

3. The hinge plate as recited in claim 2, wherein the windings are embedded in the bearing bushes.

4. The hinge plate as recited in claim 1, wherein the bearing bushes are produced from a non-magnetic material.

5. The hinge plate as recited in claim 4, wherein the bearing bushes are produced from a plastic material.

6. The hinge plate as recited in claim 1, wherein the hinge plate pin includes a paramagnetic material.

7. The hinge plate as recited in claim 1, wherein the hinge plate pin includes a ferromagnetic material.

8. The hinge plate as recited in claim 1, wherein the hinge plate pin includes a core comprising a mechanically stable material, the core extending over at least a part of a length of the hinge plate pin, and an envelope comprising at least one of a paramagnetic or a ferromagnetic material surrounding the core.

9. The hinge plate as recited in claim 8, wherein the envelope includes a plurality of layers produced from a transformer sheet, wherein the plurality of layers are separated electrically.

10. The hinge plate as recited in claim 8, wherein the envelope includes at least one ferritic layer.

11. The plate as recited in claim 8, wherein the envelope includes at least one layer produced from a ferromagnetic compressed powder material.

12. The hinge plate as recited in claim 1, wherein the frame hinge part and the leaf hinge part each include a flux guiding device configured to guide an electromagnetic flux through the hinge plate pin.

13. The hinge plate as recited in claim 12, wherein the flux guiding device on each of the frame hinge part and the leaf hinge part includes at least one end cap which comprise a paramagnetic material or a ferromagnetic material.

14. The hinge plate as recited in claim 13, wherein the flux guiding device includes flux guiding regions comprising a paramagnetic material or a ferromagnetic material and extending approximately parallel to the hinge axis to the at least one end cap.

15. The hinge plate as recited in claim 14, wherein the flux guiding regions of the frame hinge part and of the leaf hinge part are disposed opposite each other at least substantially on respective end faces of the frame hinge part and the leaf hinge part facing each other with the leaf closed.

* * * * *